US011214085B2

(12) United States Patent
Torii et al.

(10) Patent No.: US 11,214,085 B2
(45) Date of Patent: Jan. 4, 2022

(54) CONVEYING DEVICE AND IMAGE FORMING DEVICE

(71) Applicant: KYOCERA Document Solutions Inc., Osaka (JP)

(72) Inventors: Yasuhiro Torii, Osaka (JP); Yuki Tamura, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/931,666

(22) Filed: Jul. 17, 2020

(65) Prior Publication Data

US 2021/0023861 A1 Jan. 28, 2021

(30) Foreign Application Priority Data

Jul. 24, 2019 (JP) ..... JP2019-136149

(51) Int. Cl.

| | |
|---|---|
| ***B41J 17/24*** | (2006.01) |
| ***B41J 11/00*** | (2006.01) |
| ***B41J 13/02*** | (2006.01) |
| *B41J 15/04* | (2006.01) |
| *B41J 11/42* | (2006.01) |

(52) U.S. Cl.

CPC ..... *B41J 17/24* (2013.01); *B41J 11/007* (2013.01); *B41J 11/0045* (2013.01); *B41J 13/02* (2013.01); *B41J 11/42* (2013.01); *B41J 15/046* (2013.01)

(58) Field of Classification Search

CPC ..... B41J 17/24; B41J 11/0045; B41J 13/02; B41J 11/007; B41J 15/046; B41J 11/42; B41J 15/16

See application file for complete search history.

(56) References Cited

U.S. PATENT DOCUMENTS

| | | | | |
|---|---|---|---|---|
| 2017/0050452 | A1* | 2/2017 | Hamano | B65H 23/198 |
| 2019/0344595 | A1* | 11/2019 | Akahane | B41J 15/165 |
| 2020/0071113 | A1* | 3/2020 | Hamano | B65H 23/1825 |

FOREIGN PATENT DOCUMENTS

| | | |
|---|---|---|
| JP | 2016-199332 | 12/2016 |

* cited by examiner

*Primary Examiner* — Henok D Legesse

(74) *Attorney, Agent, or Firm* — Gerald E. Hespos; Michael J. Porco; Matthew T. Hespos

(57) ABSTRACT

A conveying device includes a controller configured to control conveyance of a workpiece. The controller includes a first calculator configured to calculate a first roll estimated radius of a first roll varied as a first support shaft rotates. The controller further includes a second calculator configured to calculate a second roll estimated radius of a second roll varied as a second support shaft rotates. The controller also includes a first support shaft drive controller configured to cause a first support shaft driving motor to rotary drive at a first angular velocity according to the first roll estimated radius. The controller further includes a second support shaft drive controller configured to cause a second support shaft driving motor to rotary drive at a second angular velocity according to the second roll estimated radius.

5 Claims, 9 Drawing Sheets

FIG. 8

ANGULAR VELOCITY CONTRAST INFORMATION J1

| J11 | J12 |
|---|---|
| ANGULAR VELOCITY OF FIRST /SECOND SUPPORT SHAFT DRIVING MOTOR (rad/min) | ANGULAR VELOCITY OF FIRST /SECOND SUPPORT SHAFT (rad/min) |
| MRS1 | ARS1 |
| MRS2 | ARS2 |
| MRS3 | ARS3 |
| MRS4 | ARS4 |
| MRS5 | ARS5 |

FIG. 9

MOTOR DRIVE RELATED INFORMATION J2

| J21<br>ROLL RADIUS<br>(mm) | J11<br>ANGULAR VELOCITY OF FIRST /SECOND SUPPORT SHAFT DRIVING MOTOR<br>(rad/min) |
|---|---|
| RR1~RR2 | MRS1 |
| RR2~RR3 | MRS2 |
| RR3~RR4 | MRS3 |
| RR4~RR5 | MRS4 |
| RR5~RR6 | MRS5 |

CONVEYING DEVICE AND IMAGE FORMING DEVICE

INCORPORATION BY REFERENCE

This application is based on JP 2019-136149 filed to Japan Patent Office on Jul. 24, 2019, and contents thereof are incorporated by reference.

BACKGROUND

Field of the Invention

The present disclosure relates to a conveying device configured to convey a predetermined workpiece, and an image forming device including the conveying device.

Related Art

Examples of the image forming device configured to form an image on the predetermined workpiece include an inkjet printer equipped with a liquid jetting head (image forming unit) configured to jet small quantity of ink (liquid) toward an image formation target. When the workpiece is conveyed in a predetermined conveyance direction and the liquid jetting head jets ink while being reciprocating in a scan direction perpendicular to the conveyance direction, the workpiece is then provided thereon with a letter or an image.

The conventional inkjet printer includes a conveying device configured to convey a workpiece by winding, when a winding roll rotates, the workpiece delivered from a rotating delivering roll.

SUMMARY

A conveying device according to an aspect of the present disclosure includes a conveying unit, a delivering unit, a winding unit, and a controller.

The conveying unit includes a conveying roller configured to convey a predetermined workpiece such that the workpiece passes an image formed position where image formation processing is executed on the workpiece, and a conveyance driving motor configured to generate drive power to rotate the conveying roller. The conveying unit is configured to convey the workpiece when the conveying roller rotary driven by the conveyance driving motor rotates. The delivering unit includes a first support shaft supporting a first roll constituted by the wound workpiece to be subject to the image formation processing, and a first support shaft driving motor configured to generate drive power to rotate the first support shaft. The delivering unit is configured to deliver the workpiece from the first roll toward the conveying roller when the first support shaft rotary driven by the first support shaft driving motor rotates. The winding unit includes a second support shaft supporting a second roll constituted by the wound workpiece having been subjected to the image formation processing, and a second support shaft driving motor configured to generate drive power to rotate the second support shaft. The winding unit is configured to wind the workpiece delivered from the first roll and passed the conveying roller while forming the second roll on the second support shaft, when the second support shaft rotary driven by the second support shaft driving motor rotates. The controller is configured to control the conveyance driving motor, the first support shaft driving motor, and the second support shaft driving motor.

The controller includes a conveyance drive controller, a first calculator, a second calculator, a first support shaft drive controller, and a second support shaft drive controller. The conveyance drive controller is configured to output a drive command signal to the conveyance driving motor at timing of the image formation processing executed at the image formed position, and cause the conveyance driving motor to rotary drive such that the conveying roller conveys the workpiece by a predetermined reference conveyance amount. The first calculator is configured to calculate a first roll estimated radius indicating an estimated value of a roll radius of the first roll varied as the first support shaft rotates, in accordance with first rotary driven time required by the first support shaft driving motor to deliver, from the first support shaft, the workpiece by an amount corresponding to the reference conveyance amount. The second calculator is configured to calculate a second roll estimated radius indicating an estimated value of a roll radius of the second roll varied as the second support shaft rotates, in accordance with second rotary driven time required by the second support shaft driving motor to wind, on the second support shaft, the workpiece by an amount corresponding to the reference conveyance amount. The first support shaft drive controller is configured to set, with reference to the first roll estimated radius, a first angular velocity of the first support shaft driving motor rotary driving in accordance with the drive command signal, and causes the first support shaft driving motor to rotary drive at the first angular velocity. The second support shaft drive controller sets, with reference to the second roll estimated radius, a second angular velocity of the second support shaft driving motor rotary driving in accordance with the drive command signal, and causes the second support shaft driving motor to rotary drive at the second angular velocity.

BRIEF DESCRIPTION OF THE DRAWINGS

FIG. 8 is an explanatory view of angular velocity contrast information stored in a storage unit included in a conveyance controller; and FIG. 9 is an explanatory view of motor drive related information stored in the storage unit included in the conveyance controller.

DETAILED DESCRIPTION

Figure 1:
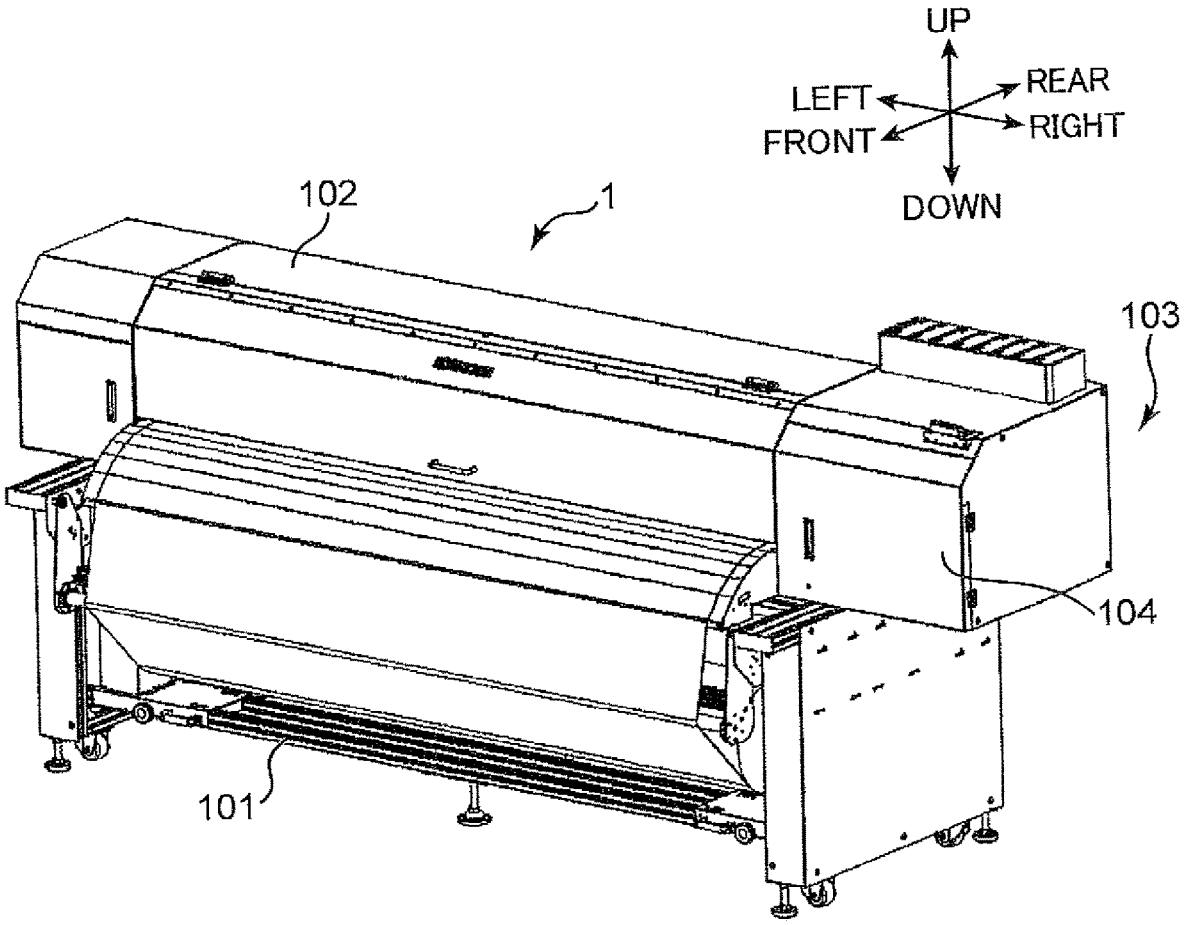
FIG. 1 is a perspective view depicting outer appearance of an image forming device according to an embodiment of the present disclosure.
Figure 2:
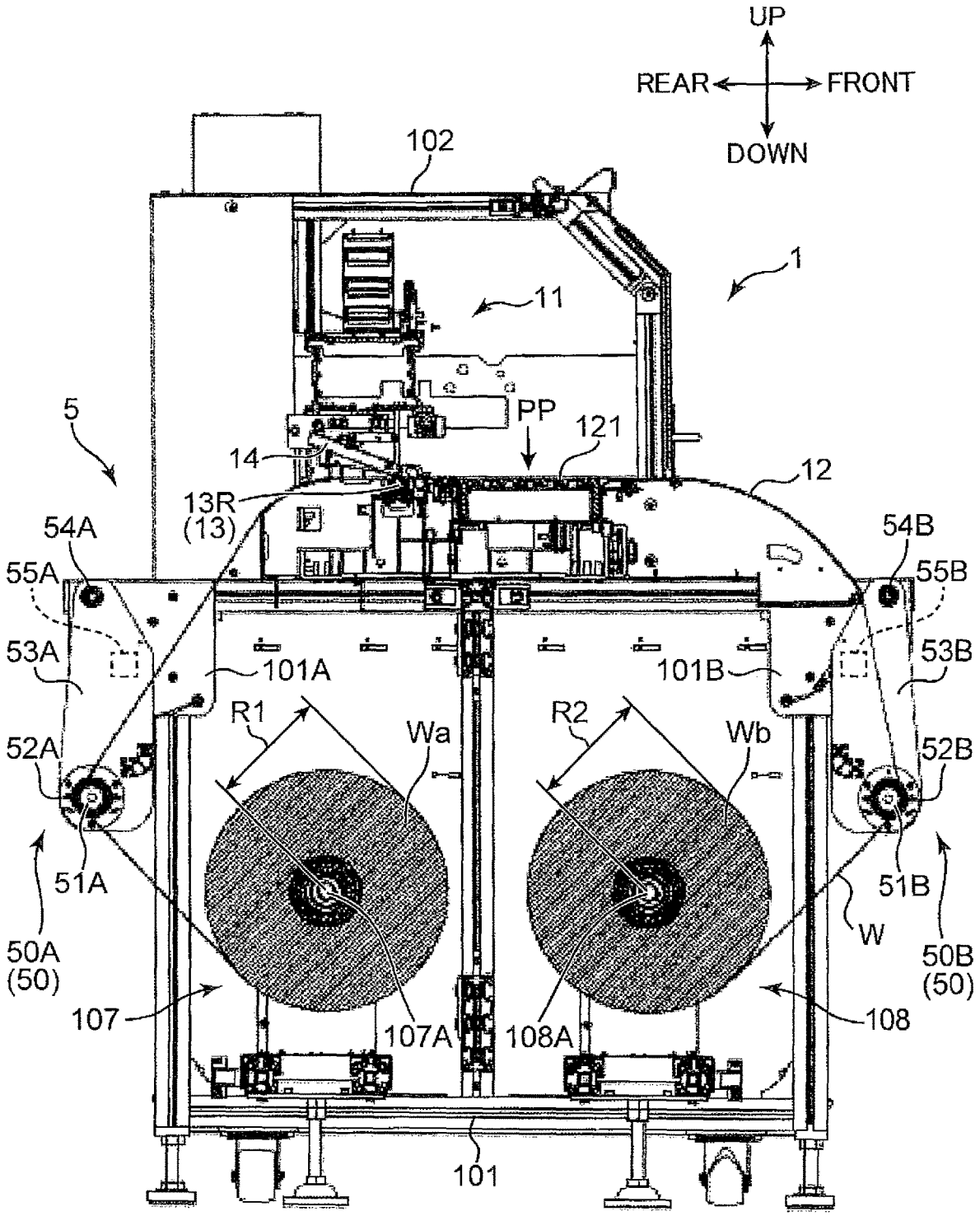
FIG. 2 is a sectional view of the image forming device.
Figure 3:
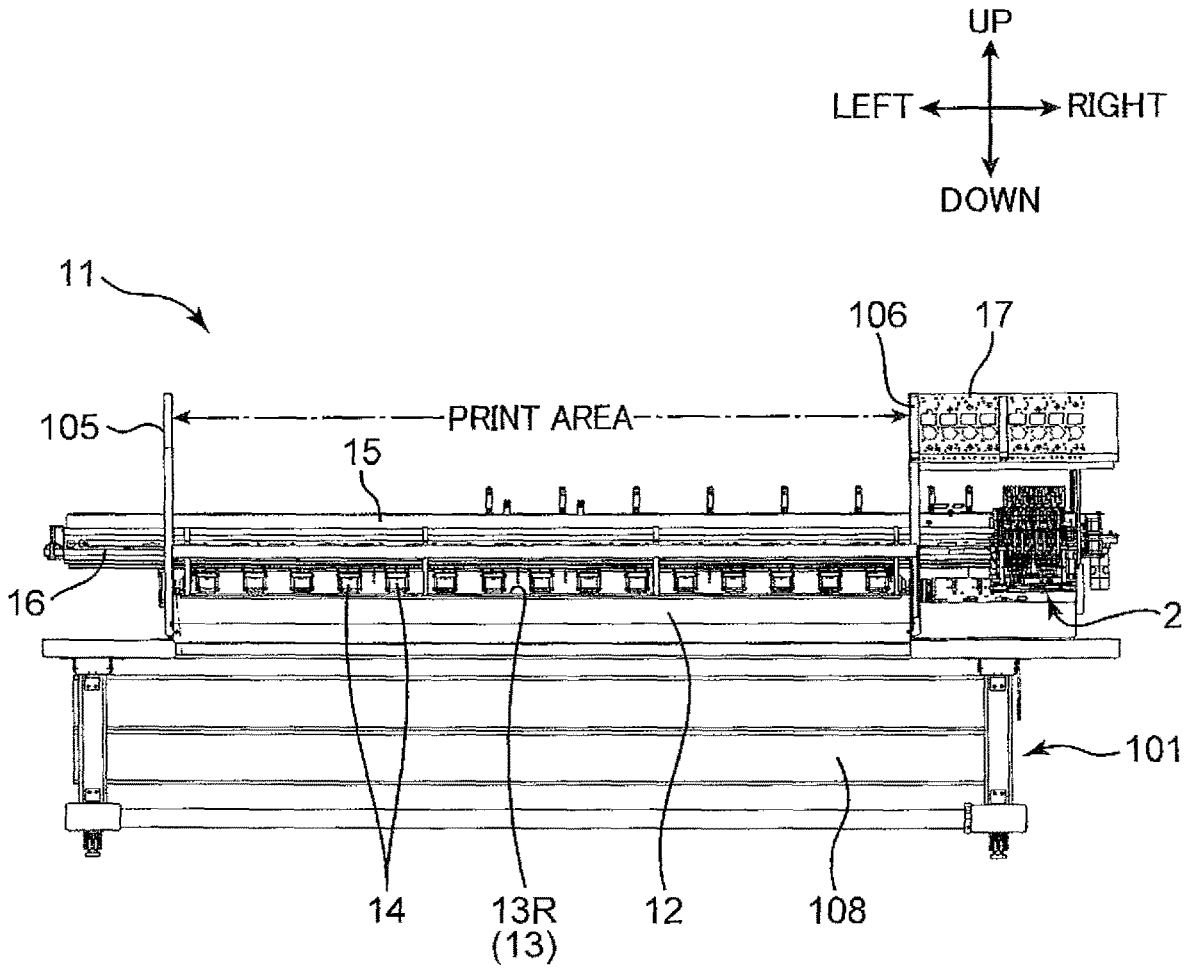
FIG. 3 is a front view of the image forming device excluding an outer cover.
Figure 4:
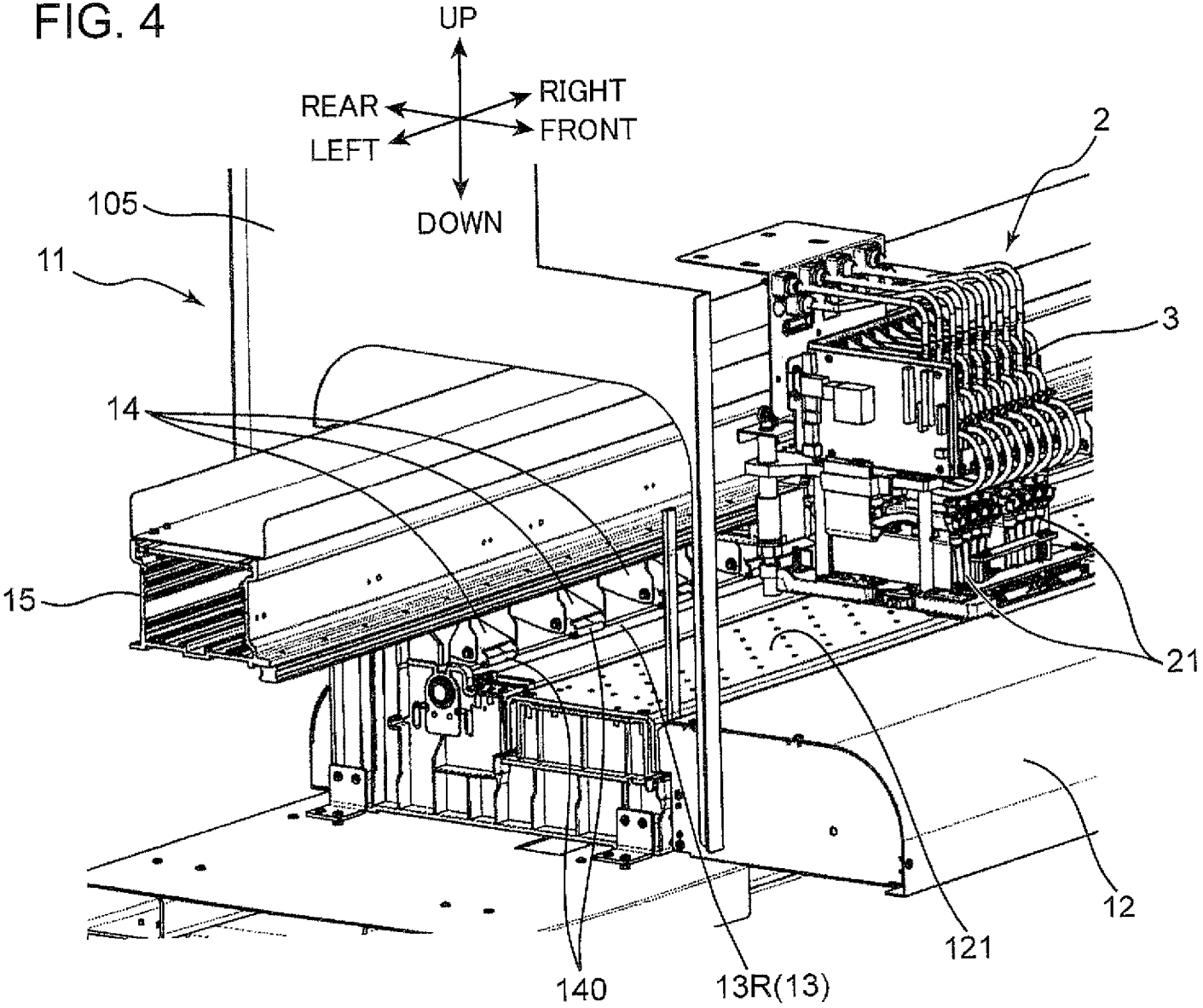
FIG. 4 is an enlarged perspective view depicting part of the image forming device excluding the outer cover.

An image forming device including a conveying device according to an embodiment of the present disclosure will be described hereinafter with reference to the drawings. FIG. 1 is a perspective view depicting outer appearance of an image forming device 1 according to an embodiment of the present disclosure, and FIG. 2 is a sectional view of the image forming device 1. FIG. 3 is a front view of the image forming device 1 excluding an outer cover 102, and FIG. 4 is an enlarged perspective view depicting part of the image forming device 1 excluding the outer cover 102. FIG. 1 to FIG. 4 and the figures to be referred to later have indication of directions including front, rear, right, left, up, and down for easier description with no intention of directional limitation.

The image forming device 1 is configured to execute image formation processing (print processing) of printing letters, images, or the like by jetting ink on various workpieces W such as paper sheets, resin sheets, fabric materials, and the like having various sizes, and is particularly appropriate for the image formation processing on the workpiece W that is large in size and length. The image forming device 1 includes a base frame 101 provided with casters, and a device body 11 mounted on the base frame 101 and configured to execute the image formation processing.

The device body 11 includes a carriage 2, and a conveying device 5 having a workpiece conveyance path 12, a conveying unit 13, and a plurality of pinch roller units 14. The conveying device 5 is configured to convey the workpiece W forward such that the workpiece W passes an image formed position PP where the image formation processing is executed on the workpiece W. The workpiece conveyance path 12 extends in a front-rear direction to allow the workpiece W to be subject to the image formation processing to be conveyed from behind into the device body 11 and be conveyed out forward.

Figure 7:
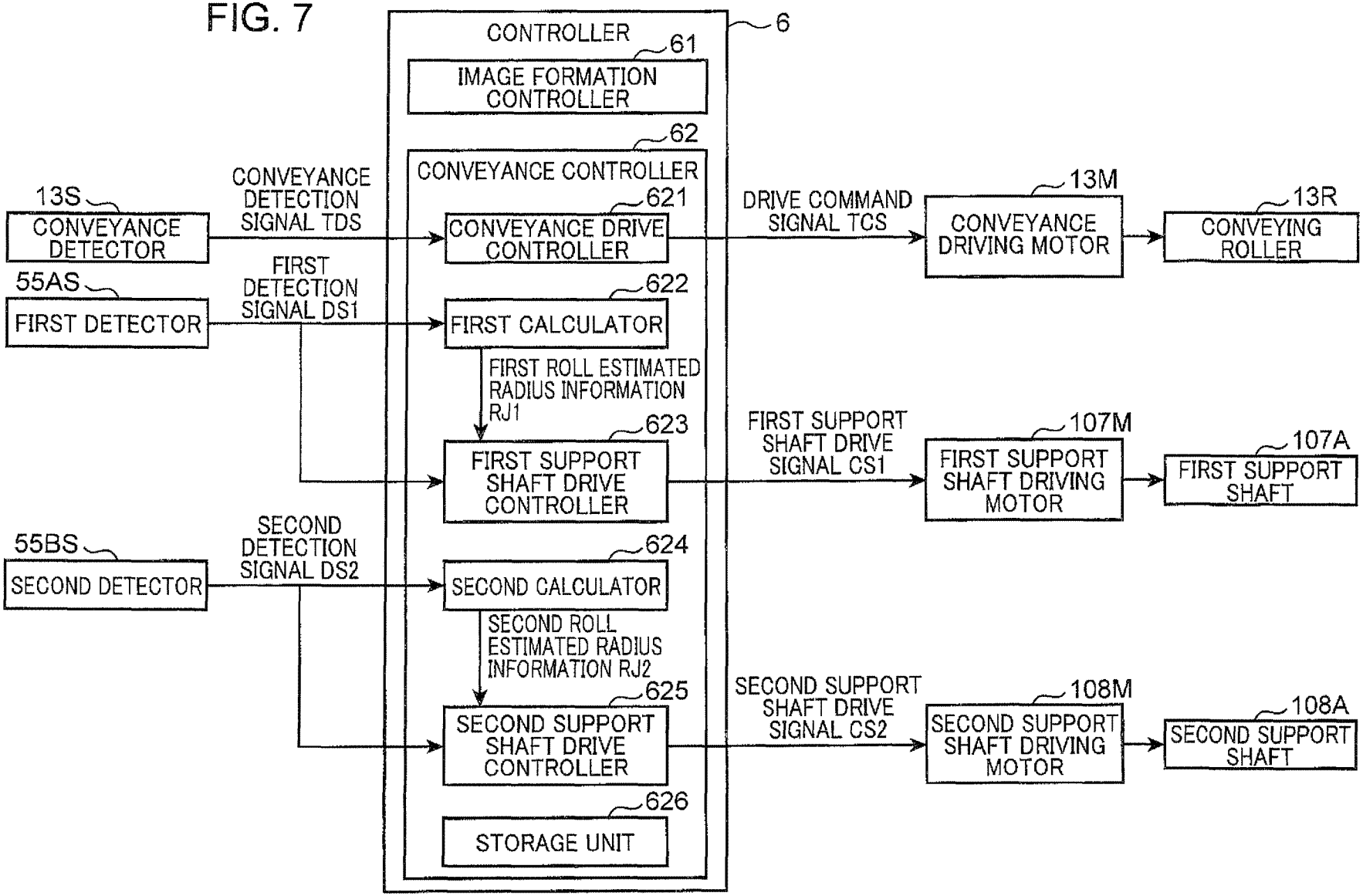
FIG. 7 is a block diagram of a control system for the image forming device.

The conveying unit 13 is configured to generate drive power to intermittently deliver the workpiece W on the workpiece conveyance path 12. The conveying unit 13 includes a conveying roller 13R and a conveyance driving motor 13M (FIG. 7). The conveying roller 13R is disposed above the base frame 101, extends laterally, and is configured to convey the workpiece W. In other words, the conveying roller 13R is rotated about a predetermined laterally extending axis to convey the workpiece W forward such that the workpiece W passes the image formed position PP opposing a head unit 21 (image forming unit). The conveyance driving motor 13M is configured to generate drive power to rotate the conveying roller 13R. The conveyance driving motor 13M is constituted by a servomotor or the like to achieve precise conveyance of the workpiece W by means of the conveying roller 13R. The conveying unit 13 conveys the workpiece W when the conveying roller 13R rotary driven by the conveyance driving motor 13M rotates, such that the workpiece W passes the image formed position PP.

The pinch roller units 14 are disposed above the conveying roller 13R to oppose the conveying roller 13R, and each include a pinch roller 140 to form a conveyance nip portion together with the conveying roller 13R. The plurality of pinch roller units 14 is disposed, at predetermined intervals, laterally along the conveying roller 13R.

The carriage 2 is a mobile body that is equipped with a unit configured to execute the image formation processing on the workpiece W and is reciprocatable in the left-right direction on the base frame 101. The base frame 101 is provided thereabove with a carriage guide 15 including a guide rail for the reciprocating carriage 2 and extending laterally. The carriage guide 15 is provided with a timing belt 16 assembled to be revolvable rightward and leftward. The carriage 2 has a part fixed to the timing belt 16, and shifts laterally along with forward or reverse revolution of the timing belt 16 while being guided by the guide rail.

The image formation processing is executed such that the conveying roller 13R and the pinch roller units 14 intermittently deliver the workpiece W and the carriage 2 shifts laterally to scan for printing on the workpiece W while the workpiece W is stopped. The workpiece conveyance path 12 includes a platen 121 (FIGS. 2 and 4) disposed below a route of the shifting carriage 2 and configured to suck the workpiece W. The platen 121 accordingly includes the image formed position PP for the workpiece W. During the image formation processing, the carriage 2 scans for printing while the workpiece W is sucked to the platen 121.

The device body 11 is covered with the outer cover 102. There is provided a side station 103 on the right of the outer cover 102. An immobile ink cartridge rack 17 holding an ink cartridge (not depicted) reserving ink for the image formation processing is accommodated inside the side station 103.

The side station 103 is provided thereahead with a carriage retreat area 104 as a space for the retreated carriage 2. As depicted in FIG. 3, the base frame 101 is provided with a left frame 105 and a right frame 106 standing laterally apart from each other to provide a space for the workpiece conveyance path 12. These left and right frames 105 and 106 interpose a print area for execution of the image formation processing. The carriage guide 15 is wider than the print area in the left-right direction, and the carriage 2 is shiftable rightward to outside the print area. The carriage 2 retreats to the carriage retreat area 104 when the image formation processing is not executed.

As depicted in FIG. 4, the carriage 2 is equipped with the head unit 21 configured to jet ink toward the workpiece W to execute the image formation processing on the workpiece W, and a liquid supply unit 3 configured to supply ink from the ink cartridge to the head unit 21. FIG. 4 exemplarily depicts the carriage 2 equipped with two head units 21 and eight liquid supply units 3. Specifically, four liquid supply units 3 are mounted for each of the head units 21 in order for supply of ink in cyan, magenta, yellow, and black. The carriage 2 reciprocates laterally along the carriage guide 15. The liquid supply units 3 may alternatively be filled with ink in different colors such that the two head units 21 jet ink in maximumly eight colors.

As depicted in FIG. 2, the conveying device 5 further includes a delivering unit 107, a winding unit 108, and a tension mechanism 50.

The delivering unit 107 is disposed behind the base frame 101, and includes a first support shaft 107A and a first support shaft driving motor 107M (FIG. 7). The first support shaft 107A supports a first roll Wa constituted by the wound workpiece W to be subject to the image formation processing. The first support shaft 107A extends in a width direction (left-right direction) of the workpiece W perpendicular to a conveyance direction of the workpiece W. The first support shaft driving motor 107M is configured to generate drive power to rotate the first support shaft 107A. The delivering unit 107 delivers the workpiece W from the first roll Wa on the first support shaft 107A toward the conveying roller 13R when the first support shaft 107A rotary driven by the first support shaft driving motor 107M rotates.

The winding unit 108 is disposed ahead of the base frame 101, and includes a second support shaft 108A and a second support shaft driving motor 108M. The second support shaft 108A supports a second roll Wb constituted by the wound workpiece W having been subjected to the image formation processing. The second support shaft 108A extends in the width direction (left-right direction) of the workpiece W perpendicular to the conveyance direction of the workpiece W. The second support shaft driving motor 108M is configured to generate drive power to rotate the second support shaft 108A. The winding unit 108 winds the workpiece W delivered from the first roll Wa and passed the conveying roller 13R while forming the second roll Wb on the second support shaft 108A, when the second support shaft 108A rotary driven by the second support shaft driving motor 108M rotates.

Figure 5:
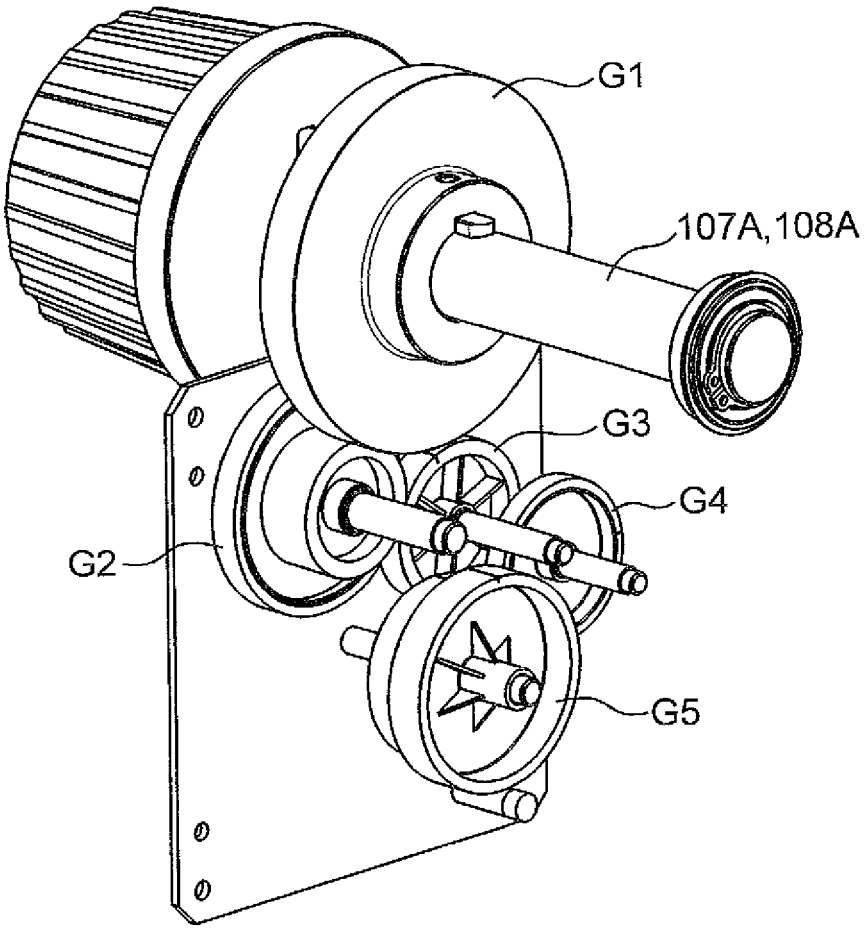
FIG. 5 is a perspective view of a driving transmission system configured to rotate a first support shaft or a second support shaft constituting a conveying device included in the image forming device.
Figure 6:
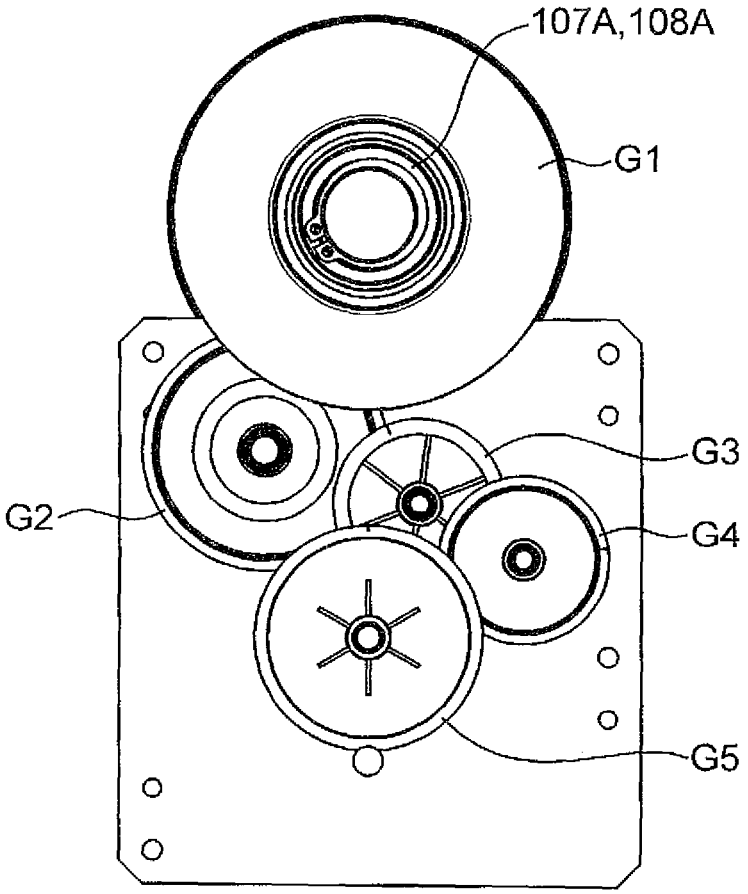
FIG. 6 is a front view of the driving transmission system configured to rotate the first support shaft or the second support shaft.

Described below with reference to a perspective view in FIG. 5 and a front view in FIG. 6 are driving transmission systems configured to rotate the first support shaft 107A and the second support shaft 108A. The driving transmission system from the first support shaft driving motor 107M to the first support shaft 107A as well as the driving transmission system from the second support shaft driving motor 108M to the second support shaft 108A are each constituted by a plurality of gears. The driving transmission systems each include a driving input gear G1 fixed to the first support shaft 107A or the second support shaft 108A, an interlocking gear G5 configured to receive rotary drive power from the first support shaft driving motor 107M or the second support shaft driving motor 108M, as well as a first transmission gear G2, a second transmission gear G3, and a third transmission gear G4 constituting a group of the plurality of transmission gears.

The driving input gear G1 is fixed to one end of the first support shaft 107A or the second support shaft 108A, and functions as a driving input unit configured to receive rotary drive power to rotate the first support shaft 107A or the second support shaft 108A. The interlocking gear G5 engages with a motor output shaft of the first support shaft driving motor 107M or the second support shaft driving motor 108M, and rotates integrally with the motor output shaft. The first transmission gear G2, the second transmission gear G3, and the third transmission gear G4 are rotatably supported by the base frame 101, and are disposed between the driving input gear G1 and the interlocking gear G5. The first transmission gear G2 engages with the driving input gear G1, the third transmission gear G4 engages with the interlocking gear G5, and the second transmission gear G3 engages with the first transmission gear G2 and the third transmission gear G4.

Rotary drive power of the first support shaft driving motor 107M or the second support shaft driving motor 108M is transmitted from the interlocking gear G5 to the third transmission gear G4, and is then received by the driving input gear G1 via the first transmission gear G2 and the second transmission gear G3. When the driving input gear G1 receives rotary drive power of the first support shaft driving motor 107M or the second support shaft driving motor 108M, the first support shaft 107A or the second support shaft 108A rotates. In this case, the first support shaft 107A or the second support shaft 108A has rotational speed reduced in accordance with rotational speed of the first support shaft driving motor 107M or the second support shaft driving motor 108M, respectively.

The tension mechanism 50 is configured to apply tension to the workpiece W located between the first roll Wa and the second roll Wb. The tension mechanism 50 according to the present embodiment includes a first tension mechanism 50A and a second tension mechanism 50B. The first tension mechanism 50A applies tension to the workpiece W delivered from the first roll Wa before passing the conveying roller 13R. The second tension mechanism 50B applies tension to the workpiece W to be wound to the second roll Wb after passing the conveying roller 13R.

The first tension mechanism 50A includes a first tension bar 51A, a pair of first support members 52A, and a pair of first support arms 53A. The first tension bar 51A is a bar member to extend in the width direction (left-right direction) of the workpiece W. The first tension bar 51A comes into contact, from inward, with the workpiece W delivered from the first roll Wa and located between the conveying roller 13R and the first roll Wa before passing the conveying roller 13R, to apply tension to the workpiece W.

The pair of first support members 52A has a planar shape perpendicular to the first tension bar 51A, and supports axial (lateral) first and second ends of the first tension bar 51A. FIG. 2 depicts only one of the pair of first support members 52A, excluding the other first support member. The pair of first support members 52A has a disc shape and is provided, at a radial center, with a bearing that receives an axial end of the first tension bar 51A.

The pair of first support arms 53A vertically extends correspondingly to one end and the other end in the axial direction of the first tension bar 51A. The pair of first support arms 53A is fixed to a rear end frame 101A disposed at a rear end of the base frame 101, so as to be rotatable about a first rotary shaft 54A extending in the width direction (left-right direction) of the workpiece W. FIG. 2 depicts only one of the pair of first support arms 53A, excluding the other first support arm. The pair of first support arms 53A is fastened to the pair of first support members 52A, respectively, by means of fasteners. Specifically, the pair of first support arms 53A supports the one end and the other end in the axial direction of the first tension bar 51A via the pair of first support members 52A, respectively. The pair of first support arms 53A has lower ends supporting the first tension bar 51A via the pair of first support members 52A, and upper ends fixed to the rear end frame 101A so as to be rotatable about the first rotary shaft 54A.

The pair of first support arms 53A rotates about the first rotary shaft 54A in accordance with an amount of sending the workpiece W delivered by the delivering unit 107, such that the first tension bar 51A shifts as well as applies pressing force generated by the rotation to the workpiece W. The first tension mechanism 50A accordingly applies tension from the first tension bar 51A to the workpiece W when the pair of first support arms 53A rotates. As depicted in FIG. 2, the pair of first support arms 53A has surfaces opposing the rear end frame 101A and having a first detection piece 55A fixed thereto. The first detection piece 55A is detected by a first detector 55AS depicted in FIG. 7 to be referred to later.

The second tension mechanism 50B includes, similarly to the first tension mechanism 50A, a second tension bar 51B, a pair of second support members 52B, and a pair of second support arms 53B. The second tension bar 51B extends in the width direction (left-right direction) of the workpiece W. The second tension bar 51B comes into contact, from inward, with the workpiece W located between the conveying roller 13R and the second roll Wb and expected to be wound to the second roll Wb after passing the conveying roller 13R, to apply tension to the workpiece W.

The pair of second support members 52B has a planar shape perpendicular to the second tension bar 51B, and supports one end and the other end in the axial direction (lift-right direction) of the second tension bar 51B. FIG. 2 depicts only one of the pair of second support members 52B, excluding the other second support member. The pair of second support members 52B has a disc shape and is provided, at a radial center, with a bearing that receives an axial end of the second tension bar 51B.

The pair of second support arms 53B vertically extends correspondingly to the one end and the other end in the axial direction of the second tension bar 51B. The pair of second support arms 53B is fixed to a front end frame 101B disposed at a front end of the base frame 101, so as to be rotatable about a second rotary shaft 54B extending in the width direction (left-right direction) of the workpiece W. FIG. 2 depicts only one of the pair of second support arms 53B, excluding the other second support arm. The pair of second support arms 53B is fastened to the pair of second support members 52B, respectively, by means of fasteners. Specifically, the pair of second support arms 53B supports the one end and the other end in the axial direction of the second tension bar 51B via the pair of second support members 52B, respectively. The pair of second support arms 53B has lower ends supporting the second tension bar 51B via the pair of second support members 52B, and upper ends fixed to the front end frame 101B so as to be rotatable about the second rotary shaft 54B.

The pair of second support arms 53B rotates about the second rotary shaft 54B in accordance with an amount of winding the workpiece W wound by the winding unit 108, such that the second tension bar 51B shifts as well as applies pressing force generated by the rotation to the workpiece W. The second tension mechanism 50B accordingly applies tension from the second tension bar 51B to the workpiece W when the pair of second support arms 53B rotates. As depicted in FIG. 2, the pair of second support arms 53B has surfaces opposing the front end frame 101B and having a second detection piece 55B fixed thereto. The second detection piece 55B is detected by a second detector 55BS depicted in FIG. 7 to be referred to later.

Described next with reference to a block diagram in FIG. 7 is a control system for the image forming device 1 and the conveying device 5 according to the present embodiment. The image forming device 1 further includes a controller 6.

The controller 6 is constituted by a microcomputer including a storage such as a read only memory (ROM) configured to store a control program and the like and a flash memory configured to temporarily store data. The controller 6 reads the control program to control operation of the image forming device 1 inclusive of the conveying device 5. The controller 6 includes an image formation controller 61 and a conveyance controller 62.

The image formation controller 61 mainly controls image forming operation of the head unit 21 and executes the image formation processing on the workpiece W.

The conveyance controller 62 constitutes part of the conveying device 5 and controls conveyance of the workpiece W executed by the conveying device 5. The conveyance controller 62 controls the conveyance driving motor 13M, the first support shaft driving motor 107M, and the second support shaft driving motor 108M, to control conveyance of the workpiece W. As depicted in FIG. 7, the conveying device 5 includes, in addition to the conveyance controller 62, a conveyance detector 13S, the first detector 55AS, and the second detector 55BS.

The conveyance detector 13S includes a pulse plate fixed to a motor output shaft of the conveyance driving motor 13M, and a conveyance detection sensor configured to detect a rotation amount of the pulse plate. The conveyance detection sensor includes a light emitter configured to emit detection light, and a light receiver configured to receive the detection light. The pulse plate has a plurality of slits opened at intervals in a rotation direction. The pulse plate rotates when the conveyance driving motor 13M rotary drives. The slits shield detection light as the pulse plate rotates. When the light receiver outputs a conveyance detection signal TDS according to a waveform generated by such light shielding, a rotation amount of the conveyance driving motor 13M is detected. Specifically, the conveyance detector 13S detects the rotation amount of the conveyance driving motor 13M and outputs the conveyance detection signal TDS indicating a result of the detection. The conveyance detection signal TDS outputted from the conveyance detector 13S is transmitted to the conveyance controller 62.

The first detector 55AS is constituted by a sensor disposed at the rear end frame 101A supporting the pair of first support arms 53A. The first detection piece 55A is located in a predetermined detection region when the pair of first support arms 53A rotates in accordance with the sending amount of the workpiece W delivered by the delivering unit 107. The first detector 55AS detects the first detection piece 55A when the first detection piece 55A is located in the detection region, and outputs a first detection signal DS1 indicating a result of the detection. The first detection signal DS1 outputted from the first detector 55AS is transmitted to the conveyance controller 62.

The second detector 55BS is constituted by a sensor disposed at the front end frame 101B supporting the pair of second support arms 53B. The second detection piece 55B is located in a predetermined detection region when the pair of second support arms 53B rotates in accordance with the winding amount of the workpiece W wound by the winding unit 108. The second detector 55BS detects the second detection piece 55B when the second detection piece 55B is located in the detection region, and outputs a second detection signal DS2 indicating a result of the detection. The second detection signal DS2 outputted from the second detector 55BS is transmitted to the conveyance controller 62.

As depicted in FIG. 7, the conveyance controller 62 includes a conveyance drive controller 621, a first calculator 622, a first support shaft drive controller 623, a second calculator 624, a second support shaft drive controller 625, and a storage unit 626.

The storage unit 626 stores information referred to for conveyance control of the workpiece W. The storage unit 626 stores angular velocity contrast information J1 indicated in FIG. 8 and motor drive related information J2 indicated in FIG. 9.

The angular velocity contrast information J1 indicated in FIG. 8 is information relating to a relationship between an angular velocity of the first support shaft driving motor 107M and the second support shaft driving motor 108M and an angular velocity of the first support shaft 107A and the second support shaft 108A. The angular velocity contrast information J1 associates motor angular velocity information J11 with support shaft angular velocity information J12.

The motor angular velocity information J11 indicates an angular velocity (rad/min) of the first support shaft driving motor 107M and the second support shaft driving motor 108M. The support shaft angular velocity information J12 indicates an angular velocity (rad/min) of the first support shaft 107A and the second support shaft 108A rotating when rotary driven by the first support shaft driving motor 107M and the second support shaft driving motor 108M, respectively.

The motor angular velocity information J11 is information indicating angular velocities "MRS1" to "MRS5" of the first support shaft driving motor 107M and the second support shaft driving motor 108M, and the angular velocities "MRS1", "MRS2", "MRS3", "MRS4", and "MRS5" are exemplified by "2760", "2000", "1450", "1050", and "760", respectively. As described earlier, the first support shaft 107A or the second support shaft 108A has the rotational speed reduced in accordance with the rotational speed of the first support shaft driving motor 107M or the second support shaft driving motor 108M, respectively. The support shaft angular velocity information J12 accordingly includes angular velocities "ARS1" to "ARS5" of the first support shaft 107A and the second support shaft 108A smaller in value than the angular velocities "MRS1" to "MRS5", respectively. Specifically, the angular velocities "ARS1" to "ARS5" included in the support shaft angular velocity information J12 have values obtained by multiplying the associated angular velocities "MRS1" to "MRS5" by a predetermined reduction ratio, and the angular velocities "ARS1", "ARS2", "ARS3", "ARS4", and "ARS5" are exemplified as "16.19", "11.73", "8.51", "6.16", and "4.46", respectively. The angular velocity contrast information J1 is referred to by the first calculator 622 and the second calculator 624 to be described later.

The motor drive related information J2 indicated in FIG. 9 includes the angular velocity of the first support shaft driving motor 107M and the second support shaft driving motor 108M during rotary drive, correspondingly to each value of the roll radius of the first roll Wa and the second roll Wb. As depicted in FIG. 2, the first roll Wa has a roll radius R1 that indicates a rotation radius of the first roll Wa and corresponds to a length from a center of the first support shaft 107A to an outer circumferential surface of the first roll Wa. Similarly, the second roll Wb has a roll radius R2 that indicates a rotation radius of the second roll Wb and corresponds to a length from a center of the second support shaft 108A to an outer circumferential surface of the second roll Wb. The motor drive related information J2 is information in which the motor angular velocity information J11 and roll radius information J21 are associated with each other.

The roll radius information J21 includes a roll radius (mm) of the first roll Wa and the second roll Wb. The roll radius of the first roll Wa and the second roll Wb included in the roll radius information J21 has a plurality of predetermined ranges. FIG. 9 exemplifies the roll radius of the first roll Wa and the second roll Wb indicated in five ranges, although the present disclosure should not be limited to this case. The roll radius of the first roll Wa and the second roll Wb included in the roll radius information J21 has ranges "RR1 to RR2", "RR2 to RR3", "RR3 to RR4", "RR4 to RR5", and "RR5 to RR6", which may be exemplified by "60 to 83", "83 to 114", "114 to 158", "158 to 217", and "217 to 300", respectively.

In the motor drive related information J2, the roll radius indicated in the roll radius information J21 and having a larger value, of the first roll Wa and the second roll Wb is associated with the angular velocity having a smaller value of the first support shaft driving motor 107M and the second support shaft driving motor 108M indicated in the motor angular velocity information J11. Information actually stored in the storage unit 626 as the motor drive related information J2 may be exemplified by control data enabling setting a smaller angular velocity as the roll radius increases. In other words, the control data may have a larger value as the roll radius increases.

The conveyance drive controller 621 controls the conveyance driving motor 13M to control rotation of the conveying roller 13R. The conveyance drive controller 621 outputs a command signal TCS at timing of the image formation processing by the head unit 21. More specifically, the conveyance drive controller 621 transmits the drive command signal TCS to the conveyance driving motor 13M while the carriage 2 is standing by until subsequent scanning for printing on the workpiece W after laterally reciprocating once. The conveyance drive controller 621 outputs the drive command signal TCS to cause the conveyance driving motor 13M to rotary drive the conveying roller 13R so as to convey the workpiece W by a predetermined reference conveyance amount.

The conveyance drive controller 621 causes the conveyance driving motor 13M to rotary drive in accordance with the conveyance detection signal TDS transmitted from the conveyance detector 13S. The conveyance driving motor 13M stops rotary driving after the workpiece W is conveyed by the reference conveyance amount along with rotation of the conveying roller 13R rotary driven by the conveyance driving motor 13M. When the conveyance driving motor 13M stops rotary driving, the head unit 21 executes the image formation processing again. The image forming device 1 executes a series of image forming operation of forming an image on the workpiece W such that the head unit 21 executes the image formation processing each time the conveying roller 13R rotates to convey the workpiece W by the reference conveyance amount.

The first calculator 622 calculates a first roll estimated radius indicating an estimated value of the roll radius of the first roll Wa varied as the first support shaft 107A rotates. The first calculator 622 calculates the first roll estimated radius in accordance with first rotary driven time of the first support shaft driving motor 107M. The first rotary driven time is time that is required to deliver, from the first support shaft 107A, the workpiece W by an amount corresponding to the reference conveyance amount indicating a workpiece conveyance amount of the conveying roller 13R.

The second calculator 624 calculates a second roll estimated radius indicating an estimated value of the roll radius of the second roll Wb varied as the second support shaft 108A rotates. The second calculator 624 calculates the second roll estimated radius in accordance with second rotary driven time of the second support shaft driving motor 108M. The second rotary driven time is time that is required to wind, on the second support shaft 108A, the workpiece W by an amount corresponding to the reference conveyance amount indicating the workpiece conveyance amount of the conveying roller 13R.

Described in more detail below are calculation of the first roll estimated radius by the first calculator 622 and calculation of the second roll estimated radius by the second calculator 624. The first calculator 622 and the second calculator 624 calculate the first roll estimated radius and the second roll estimated radius in accordance with equation (1).

$$DD=x/(\omega\times t) \tag{1}$$

Equation (1) includes "DD" indicating the first roll estimated radius (mm) or the second roll estimated radius (mm). Equation (1) also includes "x" indicating the reference conveyance amount (mm) of the workpiece W by the conveying roller 13R. Equation (1) further includes "ω" indicating an angular velocity (rad/sec) of the first support shaft 107A or the second support shaft 108A during rotation. Equation (1) also includes "t" indicating the first rotary driven time (sec) of the first support shaft driving motor 107M or the second rotary driven time (sec) of the second support shaft driving motor 108M.

Upon calculation of the first roll estimated radius "DD" according to equation (1), the first calculator 622 monitors control of the conveyance driving motor 13M by the conveyance drive controller 621 and recognizes the reference conveyance amount "x" of the workpiece W by the conveying roller 13R. The first calculator 622 also monitors the angular velocity of the first support shaft driving motor 107M and recognizes the angular velocity "ω" of the first support shaft 107A corresponding to the angular velocity of the first support shaft driving motor 107M in accordance with the angular velocity contrast information J1 stored in the storage unit 626. The first calculator 622 recognizes, as the first rotary driven time "t" of the first support shaft driving motor 107M, time from an output time point of the drive command signal TCS by the conveyance drive controller 621 to an output time point of the first detection signal DS1 by the first detector 55AS.

The first calculator 622 substitutes the reference conveyance amount "x", the angular velocity "ω" of the first support shaft 107A, and the first rotary driven time "t", which are recognized as described above, into equation (1) to calculate the first roll estimated radius "DD". The first calculator 622 calculates the current first roll estimated radius "DD" while the head unit 21 is executing the image formation processing, or while the conveying device 5 stops conveying the workpiece W. The first calculator 622 calculates the current first roll estimated radius "DD" while the conveying device 5 stops conveying the workpiece W each time the conveying roller 13R conveys the workpiece W by the reference conveyance amount "x", or each time the conveyance drive controller 621 outputs the drive command signal TCS. The first roll estimated radius "DD" calculated by the first calculator 622 is referred to when the first support shaft drive controller 623 to be described later subsequently controls the first support shaft driving motor 107M. The first calculator 622 transmits, to the first support shaft drive controller 623, first roll estimated radius information RJ1 indicating a calculation result of the first roll estimated radius "DD".

Upon calculation of the second roll estimated radius "DD" according to equation (1), similarly to the first calculator 622, the second calculator 624 monitors control of the conveyance driving motor 13M by the conveyance drive controller 621 and recognizes the reference conveyance amount "x" of the workpiece W by the conveying roller 13R. The second calculator 624 also monitors the angular velocity of the second support shaft driving motor 108M and recognizes the angular velocity "ω" of the second support shaft 108A corresponding to the angular velocity of the second support shaft driving motor 108M in accordance with the angular velocity contrast information J1 stored in the storage unit 626. The second calculator 624 recognizes, as the second rotary driven time "t" of the second support shaft driving motor 108M, time from an output time point of the drive command signal TCS by the conveyance drive controller 621 to an output time point of the second detection signal DS2 by the second detector 55BS.

The second calculator 624 substitutes the reference conveyance amount "x", the angular velocity "ω" of the second support shaft 108A, and the second rotary driven time "t", which are recognized as described above, into equation (1) to calculate the second roll estimated radius "DD". The second calculator 624 calculates the current second roll estimated radius "DD" while the head unit 21 is executing the image formation processing, or while the conveying device 5 stops conveying the workpiece W. The second calculator 624 calculates the current second roll estimated radius "DD" while the conveying device 5 stops conveying the workpiece W each time the conveying roller 13R conveys the workpiece W by the reference conveyance amount "x", or each time the conveyance drive controller 621 outputs the drive command signal TCS. The second roll estimated radius "DD" calculated by the second calculator 624 is referred to when the second support shaft drive controller 625 to be described later subsequently controls the second support shaft driving motor 108M. The second calculator 624 transmits, to the second support shaft drive controller 625, second roll estimated radius information RJ2 indicating a calculation result of the second roll estimated radius "DD".

The first support shaft drive controller 623 sets, with reference to the first roll estimated radius "DD" indicated by the first roll estimated radius information RJ1, a first angular velocity of the first support shaft driving motor 107M rotary driving in accordance with the drive command signal TCS. The first support shaft drive controller 623 sets, as the first angular velocity, an angular velocity associated with a roll radius corresponding to the first roll estimated radius "DD", in accordance with the motor drive related information J2 stored in the storage unit 626. The first support shaft drive controller 623 sets the first angular velocity of subsequent rotary drive of the first support shaft driving motor 107M while the head unit 21 is executing the image formation processing, or while the conveying device 5 stops conveying the workpiece W.

The first support shaft drive controller 623 transmits a first support shaft drive signal CS1 to the first support shaft driving motor 107M in accordance with the drive command signal TCS transmitted from the conveyance drive controller 621 to the conveyance driving motor 13M and indicating a subsequent command for conveyance of the workpiece W by the conveying device 5. The first support shaft drive controller 623 outputs the first support shaft drive signal CS1 to cause the first support shaft driving motor 107M to rotary drive at the first angular velocity. Specifically, when the conveyance drive controller 621 outputs the drive command signal TCS, the first support shaft drive controller 623 outputs the first support shaft drive signal CS1 and causes the first support shaft driving motor 107M to start rotary driving at the first angular velocity.

The first support shaft 107A rotates when rotary driven by the first support shaft driving motor 107M, and the workpiece W is delivered from the first support shaft 107A by an amount corresponding to the reference conveyance amount "x". The pair of first support arms 53A in the first tension mechanism 50A rotates when the workpiece W is delivered from the first support shaft 107A. When the workpiece W is delivered from the first support shaft 107A by an amount corresponding to the reference conveyance amount "x", the first detector 55AS detects the first detection piece 55A fixed to the pair of first support arms 53A and outputs the first detection signal DS1. When the first detector 55AS outputs the first detection signal DS1, the first support shaft drive controller 623 causes the first support shaft driving motor 107M to stop rotary driving.

As described above, the first support shaft drive controller 623 executes necessary processing each time the conveying roller 13R conveys the workpiece W by the reference conveyance amount "x". Specifically, each time the conveyance drive controller 621 outputs the drive command signal TCS, the first support shaft drive controller 623 sets the first angular velocity of the first support shaft driving motor 107M and controls to cause the first support shaft driving motor 107M to rotary drive at the first angular velocity.

The second support shaft drive controller 625 sets, with reference to the second roll estimated radius "DD" indicated by the second roll estimated radius information RJ2, a second angular velocity of the second support shaft driving motor 108M rotary driving in accordance with the drive command signal TCS. The second support shaft drive controller 625 sets, as the second angular velocity, an angular velocity associated with a roll radius corresponding to the second roll estimated radius "DD", in accordance with the motor drive related information J2 stored in the storage unit 626. The motor drive related information J2 stored in the storage unit 626 and referred to by the second support shaft drive controller 625 may be identical to, or may be set separately from, the motor drive related information J2 referred to by the first support shaft drive controller 623 The second support shaft drive controller 625 sets the second angular velocity of subsequent rotary drive of the second support shaft driving motor 108M while the head unit 21 is executing the image formation processing, or while the conveying device 5 stops conveying the workpiece W.

The second support shaft drive controller 625 transmits a second support shaft drive signal CS2 to the second support shaft driving motor 108M in accordance with the drive command signal TCS transmitted from the conveyance drive controller 621 to the conveyance driving motor 13M and indicating a subsequent command for conveyance of the workpiece W by the conveying device 5. The second support shaft drive controller 625 outputs the second support shaft drive signal CS2 to cause the second support shaft driving motor 108M to rotary drive at the second angular velocity. Specifically, when the conveyance drive controller 621 outputs the drive command signal TCS, the second support shaft drive controller 625 outputs the second support shaft drive signal CS2 and causes the second support shaft driving motor 108M to start rotary driving at the second angular velocity.

The second support shaft 108A rotates when rotary driven by the second support shaft driving motor 108M, and the workpiece W is wound on the second support shaft 108A by an amount corresponding to the reference conveyance amount "x". The pair of second support arms 53B in the second tension mechanism 50B rotates when the workpiece W is wound on the second support shaft 108A. When the workpiece W is wound on the second support shaft 108A by an amount corresponding to the reference conveyance amount "x", the second detector 55BS detects the second detection piece 55B fixed to the pair of second support arms 53B and outputs the second detection signal DS2. When the second detector 55BS outputs the second detection signal DS2, the second support shaft drive controller 625 causes the second support shaft driving motor 108M to stop rotary driving.

As described above, the second support shaft drive controller 625 executes necessary processing each time the conveying roller 13R conveys the workpiece W by the reference conveyance amount "x". Specifically, each time the conveyance drive controller 621 outputs the drive command signal TCS, the second support shaft drive controller 625 sets the second angular velocity of the second support shaft driving motor 108M and controls to cause the second support shaft driving motor 108M to rotary drive at the second angular velocity.

As described above, in the present embodiment, the workpiece W is delivered from the first roll Wa toward the conveying roller 13R when the first support shaft 107A rotary driven by the first support shaft driving motor 107M rotates. The workpiece W passed the conveying roller 13R is wound while forming the second roll Wb on the second support shaft 108A, when the second support shaft 108A rotary driven by the second support shaft driving motor 108M rotates.

The first support shaft driving motor 107M and the second support shaft driving motor 108M are controlled by the conveyance controller 62. In the conveyance controller 62, the first calculator 622 calculates the first roll estimated radius "DD" of the first roll Wa varied as the first support shaft 107A rotates. The second calculator 624 calculates the second roll estimated radius "DD" of the second roll Wb varied as the second support shaft 108A rotates. In the conveyance controller 62, the first support shaft drive controller 623 causes the first support shaft driving motor 107M to rotary drive at the first angular velocity according to the first roll estimated radius "DD". The second support shaft drive controller 625 causes the second support shaft driving motor 108M to rotary drive at the second angular velocity according to the second roll estimated radius "DD".

In the conveying device 5, each of the first support shaft 107A and the second support shaft 108A does not rotate at constant speed but rotates at the angular velocity according to the estimated value of the roll radius of the corresponding roll Wa or Wb varied as the first support shaft 107A or the second support shaft 108A rotates. This configuration inhibits any difference in conveyance amount of the workpiece W between the first roll Wa supported by the first support shaft 107A and the second roll Wb supported by the second support shaft 108A. The conveying roller 13R can thus appropriately convey the workpiece W at the image formed position PP.

Between the conveying roller 13R and the first roll Wa, the first tension bar 51A applies tension to the workpiece W when the pair of first support arms 53A rotates. Between the conveying roller 13R and the second roll Wb, the second tension bar 51B applies tension to the workpiece W when the pair of second support arms 53B rotates.

The pair of first support arms 53A rotates in accordance with the amount of sending the workpiece W delivered by the delivering unit 107, whereas the pair of second support arms 53B rotates in accordance with the amount of winding the workpiece W wound by the winding unit 108. The first support shaft driving motor 107M is controlled to rotary drive in accordance with the result of detection, by the first detector 55AS, of the first detection piece 55A fixed to the pair of first support arms 53A. The second support shaft driving motor 108M is controlled to rotary drive in accordance with the result of detection, by the second detector 55BS, of the second detection piece 55B fixed to the pair of second support arms 53B. The first support shaft 107A can be rotated depending on rotation of the pair of first support arms 53A according to the sending amount of the workpiece W delivered by the delivering unit 107. The second support shaft 108A can be rotated depending on rotation of the pair of second support arms 53B according to the winding amount of the workpiece W wound by the winding unit 108.

The first calculator 622 recognizes, as the first rotary driven time "t", time from the output time point of the drive command signal TCS to the output time point of the first detection signal DS1. The second calculator 624 recognizes, as the second rotary driven time "t", time from the output time point of the drive command signal TCS to the output time point of the second detection signal DS2. The result of detection by the first detector 55AS, which is referred to for control to cause the first support shaft driving motor 107M to rotary drive, can be used for calculation of the estimated value of the roll radius of the first roll Wa supported by the first support shaft 107A. Similarly, the result of detection by the second detector 55BS, which is referred to for control to cause the second support shaft driving motor 108M to rotary drive, can be used for calculation of the estimated value of the roll radius of the second roll Wb supported by the second support shaft 108A.

The first support shaft drive controller 623 sets, as the first angular velocity, the angular velocity associated with the roll radius corresponding to the first roll estimated radius "DD", in accordance with the motor drive related information J2 stored in the storage unit 626. The second support shaft drive controller 625 sets, as the second angular velocity, the angular velocity associated with the roll radius corresponding to the second roll estimated radius "DD", in accordance with the motor drive related information J2. This configuration enables setting the angular velocity of rotary drive of the first support shaft driving motor 107M and the second support shaft driving motor 108M, in accordance with the motor drive related information J2 stored in the storage unit 626.

The image forming device 1 according to the present embodiment includes the conveying device 5 configured to appropriately convey the workpiece W at the image formed position PP. This configuration inhibits displacement or the like of the image formed on the workpiece W, and prevents deterioration in quality of the image on the workpiece W.

The embodiment of the present disclosure has been described above, although the present disclosure should not be limited thereto but may adopt the following modified embodiment. The above embodiment relates to the image forming device 1 configured as an inkjet device, although the present disclosure should not be limited thereto. The image forming device 1 may alternatively include any other image forming unit configured in accordance with a known electrophotographic technology or the like.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A conveying device comprising:

a conveying unit including a conveying roller configured to convey a predetermined workpiece such that the workpiece passes an image formed position where image formation processing is executed on the workpiece, and a conveyance driving motor configured to generate drive power to rotate the conveying roller, the conveying unit configured to convey the workpiece when the conveying roller rotary driven by the conveyance driving motor rotates;

a delivering unit including a first support shaft supporting a first roll constituted by the wound workpiece to be subject to the image formation processing, and a first support shaft driving motor configured to generate drive power to rotate the first support shaft, the delivering unit configured to deliver the workpiece from the first roll toward the conveying roller when the first support shaft rotary driven by the first support shaft driving motor rotates;

a winding unit including a second support shaft supporting a second roll constituted by the wound workpiece having been subjected to the image formation processing, and a second support shaft driving motor configured to generate drive power to rotate the second support shaft, the winding unit configured to wind the workpiece delivered from the first roll and passed the conveying roller while forming the second roll on the second support shaft, when the second support shaft rotary driven by the second support shaft driving motor rotates; and a controller configured to control the conveyance driving motor, the first support shaft driving motor, and the second support shaft driving motor; wherein the controller includes:

a conveyance drive controller configured to output a drive command signal to the conveyance driving motor at timing of the image formation processing executed at the image formed position, and cause the conveyance driving motor to rotary drive such that the conveying roller conveys the workpiece by a predetermined reference conveyance amount;

a first calculator configured to calculate a first roll estimated radius indicating an estimated value of a roll radius of the first roll varied as the first support shaft rotates, in accordance with first rotary driven time required by the first support shaft driving motor to deliver, from the first support shaft, the workpiece by an amount corresponding to the reference conveyance amount;

a second calculator configured to calculate a second roll estimated radius indicating an estimated value of a roll radius of the second roll varied as the second support shaft rotates, in accordance with second rotary driven time required by the second support shaft driving motor to wind, on the second support shaft, the workpiece by an amount corresponding to the reference conveyance amount;

a first support shaft drive controller configured to set, with reference to the first roll estimated radius, a first angular velocity of the first support shaft driving motor rotary driving in accordance with the drive command signal, and cause the first support shaft driving motor to rotary drive at the first angular velocity; and a second support shaft drive controller configured to set, with reference to the second roll estimated radius, a second angular velocity of the second support shaft driving motor rotary driving in accordance with the drive command signal, and cause the second support shaft driving motor to rotary drive at the second angular velocity.

2. The conveying device according to claim 1, further comprising:

a first tension mechanism including a first tension bar coming into contact with the workpiece located between the conveying roller and the first roll, and a first support arm fixing a first detection piece, supporting the first tension bar, and configured to rotate in accordance with an amount of sending the workpiece delivered by the delivering unit, the first tension mechanism configured to apply tension from the first tension bar to the workpiece when the first support arm rotates;

a second tension mechanism including a second tension bar coming into contact with the workpiece located between the conveying roller and the second roll, and a second support arm fixing a second detection piece, supporting the second tension bar, and configured to rotate in accordance with an amount of winding the workpiece wound by the winding unit, the second tension mechanism configured to apply tension from the second tension bar to the workpiece when the second support arm rotates;

a first detector configured to detect the first detection piece and output a first detection signal when the first detection piece is located in a predetermined detection region as the first support arm rotates; and a second detector configured to detect the second detection piece and output a second detection signal when the second detection piece is located in a predetermined detection region as the second support arm rotates; wherein the first support shaft drive controller causes the first support shaft driving motor to start rotary driving when the conveyance drive controller outputs the drive command signal, and causes the first support shaft driving motor to stop rotary driving when the first detector outputs the first detection signal, and the second support shaft drive controller causes the second support shaft driving motor to start rotary driving when the conveyance drive controller outputs the drive command signal, and causes the second support shaft driving motor to stop rotary driving when the second detector outputs the second detection signal.

3. The conveying device according to claim 2, wherein the first calculator recognizes, as the first rotary driven time, time from an output time point of the drive command signal to an output time point of the first detection signal, and the second calculator recognizes, as the second rotary driven time, time from an output time point of the drive command signal to an output time point of the second detection signal.

4. The conveying device according to claim 1, wherein the controller further includes a storage unit configured to store motor drive related information that is information including an angular velocity of the first support shaft driving motor and the second support shaft driving motor being rotary driving, for each roll radius of the first roll and the second roll, such that the roll radius having a larger value being associated with the angular velocity having a smaller value, the first support shaft drive controller sets, as the first angular velocity, an angular velocity associated with a roll radius corresponding to the first roll estimated radius, in accordance with the motor drive related information, and the second support shaft drive controller sets, as the second angular velocity, an angular velocity associated with a roll radius corresponding to the second roll estimated radius, in accordance with the motor drive related information.

5. An image forming device comprising:

an image forming unit configured to execute image formation processing on a predetermined workpiece; and the conveying device according to claim 1, configured to convey the workpiece such that the workpiece passes an image formed position opposing the image forming unit.

* * * * *